US010654700B2

(12) United States Patent
Hecht

(10) Patent No.: US 10,654,700 B2
(45) Date of Patent: May 19, 2020

(54) BEVERAGE DISPENSER WITH VARIABLE CARBONATION CAPABILITY

(71) Applicant: Automatic Bar Controls, Inc., Vacaville, CA (US)

(72) Inventor: Thomas R. Hecht, Winters, CA (US)

(73) Assignee: Automatic Bar Controls, Inc., Vacaville, CA (US)

( * ) Notice: Subject to any disclaimer, the term of this patent is extended or adjusted under 35 U.S.C. 154(b) by 258 days.

(21) Appl. No.: 15/611,611

(22) Filed: Jun. 1, 2017

(65) Prior Publication Data

US 2018/0215603 A1 Aug. 2, 2018

Related U.S. Application Data

(60) Provisional application No. 62/344,340, filed on Jun. 1, 2016.

(51) Int. Cl.
*B67D 1/00* (2006.01)
*B67D 1/06* (2006.01)
(Continued)

(52) U.S. Cl.
CPC ..... *B67D 1/0036* (2013.01); *B67D 1/0051* (2013.01); *B67D 1/0085* (2013.01); *B67D 1/06* (2013.01); *B67D 1/0888* (2013.01); *B67D 1/1297* (2013.01); *B67D 1/16* (2013.01); *B67D 1/0046* (2013.01); *B67D 1/12* (2013.01); *B67D 1/1422* (2013.01); *B67D 2210/00091* (2013.01)

(58) Field of Classification Search
CPC .. B67D 1/0888; B67D 1/0021; B67D 1/0057; B67D 1/0406; B67D 1/0418; B67D 1/0044; B67D 1/0081; B67D 1/0036; B67D 1/0043; B67D 1/0831; B67D 1/0058; B67D 1/1213; B67D 2001/0093; B67D 1/0028; B67D 1/1209; B67D 1/025; B67D 1/104; B67D 1/0018; B67D 7/0294; B67D 4/1209; B01F 3/04808; B01F 3/04815; B01F 3/04787; B01F 2215/0022; B01F 2003/049; B01F 3/04794; B01F 15/026; B01F 2003/04893; B01F 15/00123
USPC ..... 99/275; 426/477, 590, 115, 231
See application file for complete search history.

(56) References Cited

U.S. PATENT DOCUMENTS 4,517,651 A 5/1985 Kawasaki et al.
5,033,645 A 7/1991 Shannon
(Continued)

FOREIGN PATENT DOCUMENTS

JP 2002-358570 A 12/2002
WO 2009/032941 A2 3/2009
(Continued)

OTHER PUBLICATIONS

International Preliminary Report on Patentability dated Dec. 13, 2018 in PCT/US2017/03551 filed Jun. 1, 2017. 12 pages.
(Continued)

*Primary Examiner* — Hong T Yoo
(74) *Attorney, Agent, or Firm* — Kilpatrick Townsend & Stockton LLP

(57) ABSTRACT

A method of dispensing fluids with variable carbonation. The method includes receiving a selection of a carbonation level of a beverage and determining a valve timing scheme to achieve the selected carbonation level.

13 Claims, 15 Drawing Sheets

(51) Int. Cl.

| | |
|---|---|
| ***B67D 1/08*** | (2006.01) |
| ***B67D 1/12*** | (2006.01) |
| ***B67D 1/16*** | (2006.01) |
| *B67D 1/14* | (2006.01) |

(56) References Cited

U.S. PATENT DOCUMENTS

| | | | | |
|---|---|---|---|---|
| 5,042,692 | A | 8/1991 | Valliyee et al. | |
| 2002/0092866 | A1 | 7/2002 | Newman et al. | |
| 2009/0188938 | A1 | 7/2009 | Farris et al. | |
| 2010/0127015 | A1 | 5/2010 | Boyer | |
| 2014/0188271 | A1 | 7/2014 | Hernandez et al. | |
| 2017/0043992 | A1* | 2/2017 | Green ..... | B67D 1/0036 |

FOREIGN PATENT DOCUMENTS

| | | | |
|---|---|---|---|
| WO | 2015/103399 | A1 | 7/2015 |
| WO | 2015168290 | A1 | 11/2015 |

OTHER PUBLICATIONS

International Search Report and Written Opinion dated Sep. 7, 2017 in PCT/US2017/03551 filed Jun. 1, 2017. 16 pages.
European Patent Office, extended European search report, EP Application No. 17807506 dated Jan. 3, 2020, Supplementary European Search Report, 8 pages.

* cited by examiner

BEVERAGE DISPENSER WITH VARIABLE CARBONATION CAPABILITY

CROSS-REFERENCES TO RELATED APPLICATIONS

The present application claims the benefit of U.S. Provisional Application No. 62/344,340 entitled "VARIABLE-CARBONATION ALTERNATIVE FOR BEVERAGE DISPENSERS," filed on Jun. 1, 2016, the entire contents of which are herein incorporated by reference for all purposes.

The disclosures of both application Ser. No. 12/611,788, filed Nov. 3, 2009, and Provisional Application 61/113,183, filed Nov. 10, 2008, are hereby incorporated by reference in their entirety.

BACKGROUND OF THE INVENTION

A number of beverage dispenser designs are well known in the art. These include carbonated beverage dispensers, non-carbonated beverage dispensers, beverage brewing systems, and liquor distribution systems. Many beverage dispenser designs have separate nozzles to pour (dispense) different beverages. Some beverage dispensers are capable of dispensing a variety of beverages out of a single nozzle.

One common type of a beverage dispenser with a single nozzle is a beverage gun (commonly referred to as a bar gun). A beverage gun typically includes a hand-held beverage dispensing head with a number of buttons, each corresponding to a different beverage. One example of a beverage gun is shown in U.S. Pat. No. 5,042,692 to Valiyee et al, assigned to the assignee of the instant application, the contents of which are hereby incorporated by reference.

Another common type of beverage dispenser is a beverage tower. A beverage tower is typically set on a countertop or table top. Rather than being handheld and moved to the beverage cup, as is the case with the beverage gun, the beverage tower is maintained in a generally stationary position, and the beverage cup is held or set down underneath the tower's nozzle. An example of a beverage tower is shown in the parent application Ser. No. 12/611,788, and shown in FIG. 1. Some beverage towers have one nozzle at the dispense point, as shown in FIG. 1, and some others have multiple nozzles, one for each type of beverage.

Both of these types of dispensers are generally fed by a number of beverage tubes, which in turn are connected to remotely located containers of soda water, non-carbonated water, concentrated soft drink syrups, and the like. Depending on the user-selected beverage, one or more beverage components are dispensed out of the nozzle (or one of the nozzles) simultaneously. For example, soda water and a concentrated soft drink syrup are dispensed simultaneously to serve a soft drink.

The containers of beverage components are generally located at least somewhat remotely from the beverage dispenser, so the beverage tubes are sometimes quite long, and thus have a large amount of beverage components stored within them when not in use. In addition, the beverage tubes are usually controlled by flow control valves and shutoff valves located some distance upstream of the nozzle, so some of the beverage components that remain within the tubes are located downstream of the valves. This can lead to beverage components dripping from the nozzle when the beverage dispenser is not in use, which is wasteful and messy.

This is of particular concern for beverage towers, which are often used in convenience stores and the like, and operated directly by customers rather than staff members, but it is of some concern for all beverage dispensing systems.

BRIEF SUMMARY OF THE INVENTION

Embodiments described herein provide a manifold for a liquid dispensing system made of at least two layers. The first layer has multiple through holes along its thickness direction, and one or more fluid channels perpendicular to the thickness direction. The fluid channels each have an inlet at the edge of the layer and an outlet at one of the through holes. The second layer has one or more through holes along its thickness direction, each in fluid communication with one of the through holes of the first layer. The second layer also has one or more fluid channels perpendicular to the thickness direction, each with an inlet at the edge of the layer and an outlet at one of the through holes. The second layer also has one or more additional holes that define valve bores. Each valve bore can have a valve placed within it to control flow of a liquid to a respective one of the fluid channels of the second layer.

Other embodiments described herein provide a liquid dispensing system that includes the above-described manifold. The system also includes liquid supply tubes, each attached to an inlet of one of the fluid channels. The liquid supply tubes, the fluid channels, and the through holes cooperatively define liquid paths. The system also has a valve operatively associated with each liquid path, to control the flow of liquid therein, where at least one of the valves is disposed in a valve bore defined by the manifold.

Still further embodiments described herein provide a method of manufacturing a manifold for use in a liquid dispensing system. A first layer is manufactured, where the first layer has several through holes along its thickness direction and one or more fluid channels perpendicular to the thickness direction. A second layer is manufactured, where the second layer has one or more through holes along its thickness direction, one or more fluid channels perpendicular to the thickness direction, and one or more additional holes that define valve bores. The first layer is attached directly or indirectly to the second layer.

Still further embodiments described herein provide dispensing beverages with selectable carbonation levels.

For a further understanding of the nature and advantages of the invention, reference should be made to the following description taken in conjunction with the accompanying figures. It is to be expressly understood, however, that each of the figures is provided for the purpose of illustration and description only and is not intended as a definition of the limits of the embodiments of the present invention.

DETAILED DESCRIPTION OF THE INVENTION

Figure 1:
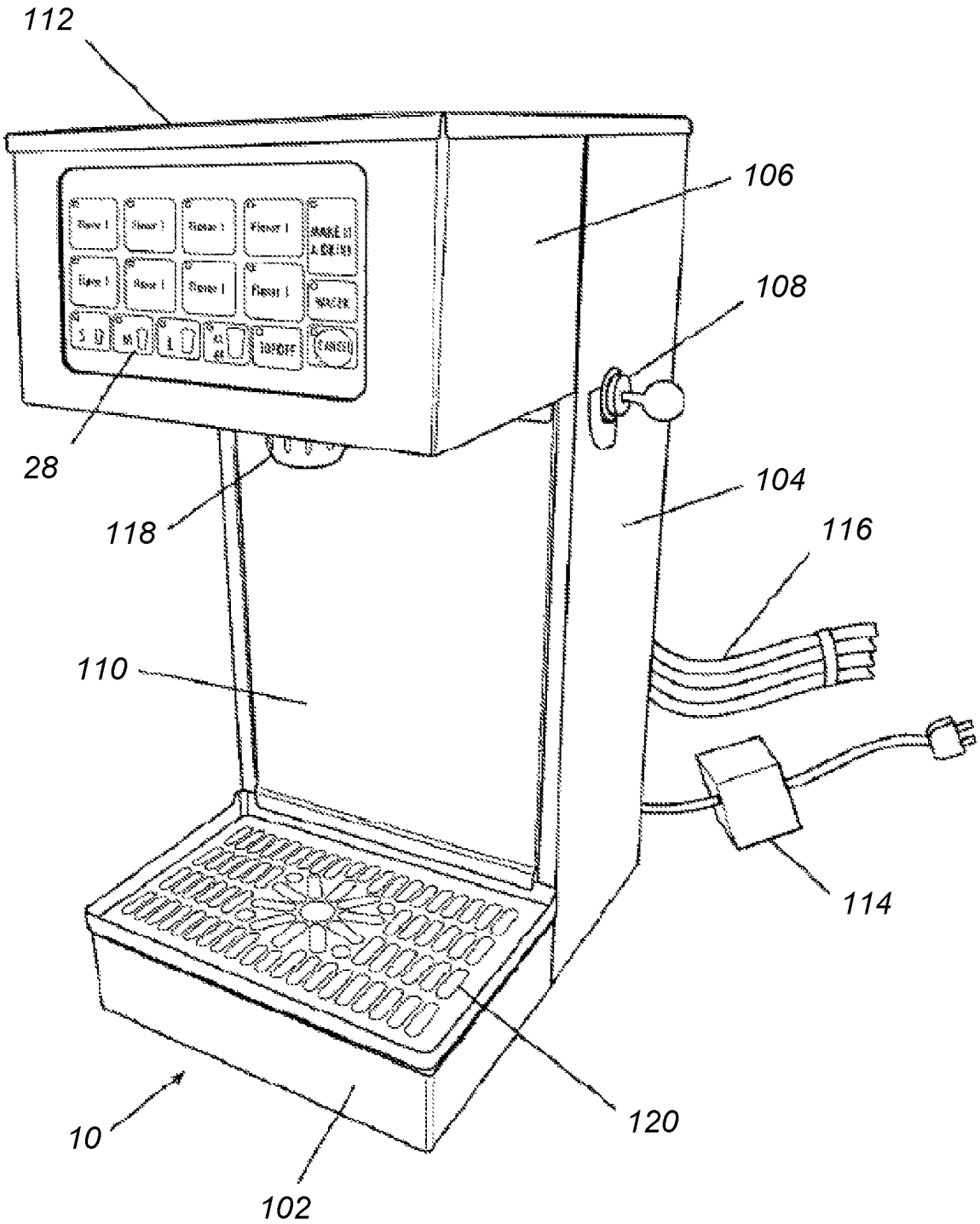
FIG. 1 is a perspective view of a beverage tower according to many embodiments.
Figure 2:
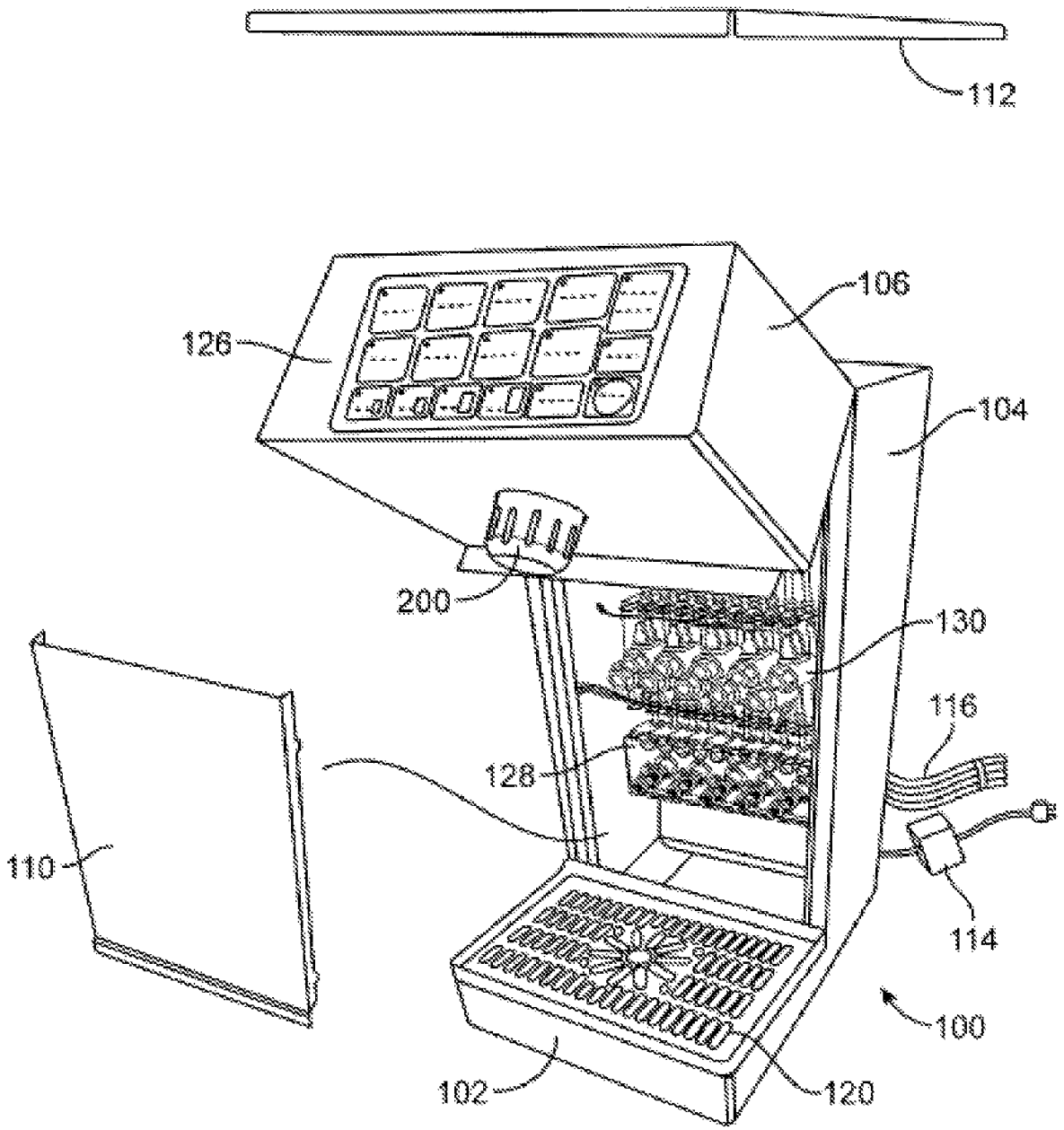
FIG. 2 shows the beverage tower of FIG. 1 in its opened state.
Figure 3:
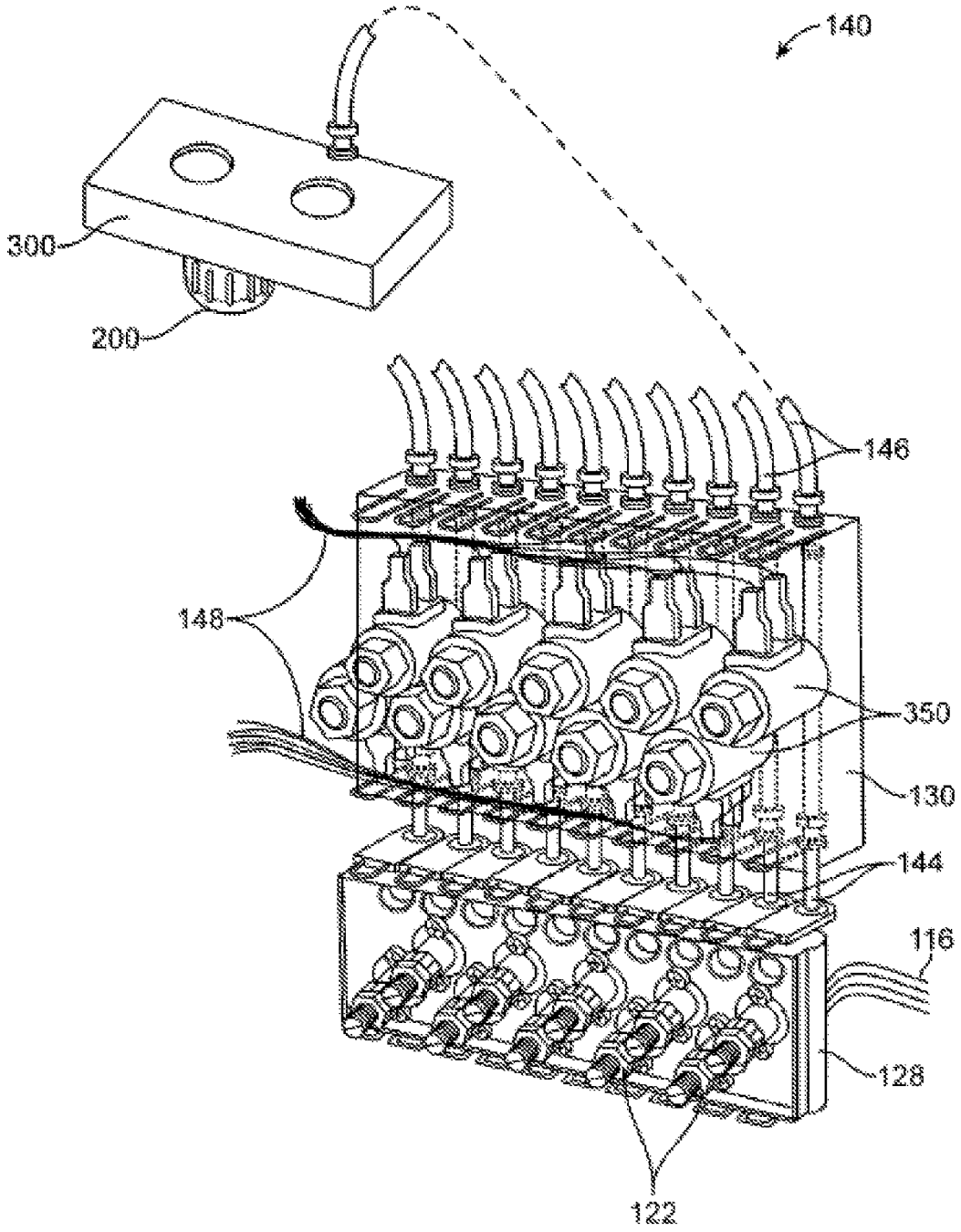
FIG. 3 is a perspective view of a flow control system according to many embodiments.

Referring to FIGS. 1-3, some embodiments of a beverage dispenser 100 include a diffuser block 300 located immediately upstream of a dispensing nozzle 200. In some embodiments, the diffuser block 300 delivers each of the beverage fluids dispensed to separate output orifices of a discharge nozzle 200 for the beverage dispenser 100. Discharging each of the beverage fluids from separate output orifices may decrease contamination of a beverage from previously dispensed beverages. In some embodiments, the diffuser block includes a provision for a shutoff or solenoid valve 350 for carbonated water and/or a provision for a solenoid valve 350 for non-carbonated water. Placing a shutoff or solenoid valve on the diffuser block reduces the distance between the solenoid valve and the nozzle. Reducing the distance from a solenoid valve for carbonated water to the nozzle may decrease the loss of carbonation in a carbonated beverage, and may prevent dripping and foaming, as will be explained later.

Beverage Dispenser

FIG. 1 shows a tower type beverage dispenser 100, in accordance with many embodiments. The beverage dispenser 100 receives a plurality of beverage fluids from a corresponding plurality of supply lines, bundled into a system of input tubing 116. Referring also to FIG. 3, the beverage dispenser 100 includes flow rate control devices 122, shutoff valves 350, a control unit (not shown), a control panel 126 (FIG. 1), and a nozzle 200. The beverage dispenser can also include a diffuser block 300, for distributing beverage fluid(s) discharged from the shutoff valves 350 to the nozzle 200.

The flow rate control devices 122 can include a flow rate control device coupled with each of one or more of the supply lines of the input tubing 116. Each flow rate control device can be used to control the rate of flow of a beverage fluid communicated by one of the supply lines. Each of the flow rate control devices can be an adjustable device (e.g., an adjustable valve) configurable to provide a desired flow rate for the beverage fluid.

The shutoff valves 350 may include a solenoid valve 350 for each of the beverage fluid supply lines. Each of the solenoid valves 350 can be individually controlled to control the discharge of an associated beverage fluid. For example, one solenoid valve can be opened to discharge a quantity of carbonated water, and another solenoid valve can be opened to discharge an appropriate quantity of beverage additive. The discharged quantities of carbonated water and beverage additive can be mixed in the diffuser block 300 and dispensed from the nozzle 200 as a mixed beverage. The discharged quantities can also be separately dispensed from separate discharge ports in the nozzle. Such separate dispensing may help to reduce cross contamination between beverage fluids.

The beverage dispenser 100 is capable of receiving water from a water source (not shown), carbonated water from a carbonator (not shown), and/or one or more beverage additives from beverage additive sources (not shown), through the input tubing 116. A beverage additive can be, for example, tea flavorings, coffee flavorings, vitamin shots, sweetener shots, concentrated soft drink syrups, etc. One or more beverage additives can be transferred from the beverage additive sources to the beverage dispenser 100 by the input tubing 116. The one or more beverage sources can include bag-in-box systems, as will be understood by those of ordinary skill in the art.

Water supplied to the beverage dispenser 100 can be supplied from any water source through the input tubing 116. The water and/or the carbonated water can be circulated through prechillers or preheaters (not shown) before being supplied to the beverage dispenser 100. The prechillers or preheaters can be any suitable device for lowering or raising the temperature of the water and/or the carbonated water supplied to the beverage dispenser 100. The prechillers or preheaters can be incorporated into the beverage dispenser 100. The prechillers or preheaters can be separate devices or integrated into a single device.

The beverage dispenser 100 can be configured to receive non-carbonated water and/or carbonated water. In order to receive carbonated water, the water supplied to the beverage dispenser 100 can have carbon dioxide ($CO_2$) added to it by a carbonator. The carbonator can be any suitable device that is capable of dissolving carbon dioxide in water or any other liquid or aqueous solution. Carbonated water can be supplied directly to the beverage dispenser 100 by the carbonator or, alternatively, the carbonated water can be circulated through the prechiller before it is supplied to the beverage dispenser 100. The water can additionally or alternatively be circulated through the prechiller before it is supplied to the carbonator. The carbonator can be incorporated into the beverage dispenser 100 or, alternatively, the carbonator can be a separate device. For purposes of illustration, both carbonated water and non-carbonated water are illustrated and described herein as being supplied to the beverage dispenser 100. However, supplying both carbonated and non-carbonated water is not required.

The beverage dispenser 100 can be capable of dispensing one or more beverage fluids used to make a beverage. As used herein, a "beverage fluid" refers to any fluid constituent of a beverage, for example, a beverage additive, water, carbonated water, various types of alcoholic beverages, or any other beverage fluid constituent. The beverage dispenser 100 can also be capable of dispensing a mixed beverage by mixing one or more beverage additives with non-carbonated water and/or carbonated water, or by mixing two or more beverages or beverage components together. The beverage dispenser 100 can also be capable of dispensing a beverage that does not necessarily require mixing. For example, the beverage dispenser 100 can be capable of dispensing wine, beer, juice, spirits, or premixed soft drinks or cocktails. In addition, the beverage dispenser 100 can be capable of dispensing non-carbonated water or carbonated water.

Additionally, the beverage dispenser 100 can be capable of dispensing carbonated beverages by adding carbon dioxide to a mixed beverage or by mixing carbonated water with a beverage additive. The beverage dispenser 100 can be implemented to dispense many different types of flavorings or beverage additives, flavored beverages, and mixed beverages. For instance, different tea flavorings can be provided to the beverage dispenser 100 to create a variety of mixed tea beverages. The beverage dispenser 100 can be used to dispense various flavorings and beverages, including but not limited to water, tea, coffee, juices, energy drinks, vitamin-fortified beverages, sodas, beer, wine, spirits, or cocktails.

FIG. 1 is a perspective view of a beverage dispenser 100. The beverage dispenser 100 includes a base 102, a trunk 104, and an upper portion 106. The beverage dispenser 100 also includes a lock and key mechanism 108, a front access panel 110, a top access panel 112, an electric plug assembly 114, input tubing 116, a control panel 126, a nozzle 200, and a drip pan 120.

Although the base 102 is free standing in the illustrated example, the base 102 can be fixedly or removably attached to a surface such as a counter. The base 102 of the beverage dispenser 100 is also fixedly or removably attached to the trunk 104. The upper portion 106 is attached to the trunk 104 of the beverage dispenser 100 by hinges (not shown). The hinges allow for easy opening of the beverage dispenser 100, as will be explained in greater detail below. Although hinges are used in this embodiment, other suitable mechanisms can be used to attach the upper portion 106 to the trunk 104. For example, a variety of screws, tabs, snaps, bolts, or other fixed or movable devices can be used to facilitate attachment.

The top access panel 112 can be removably attached on top of both the upper portion 106 and the trunk 104. The top access panel 112 can provide protection to internal components of the beverage dispenser 100, and the top access panel 112 can also prevent the beverage dispenser 100 from being opened when it is in place. The top access panel 112 can simply rest on top of the beverage dispenser 100 or, alternatively, it can be secured in place on the beverage dispenser 100. A variety of screws, tabs, snaps, bolts, or other devices can be used to facilitate the secured attachment of the top access panel 112 to the beverage dispenser 100, and the attachment can be a fixed attachment or a moveable attachment.

The opening or closing of the beverage dispenser 100 and/or delivery of power to the beverage dispenser 100 can be controlled by the lock and key mechanism 108. For example, when the lock and key mechanism 108 is unlocked and the top access panel 112 is removed, the upper portion 106 of the beverage dispenser 100 can be opened upward (as shown in FIG. 2) to allow easy access to internal components of the beverage dispenser 100. Additionally, when the upper portion 106 is in an opened position, the front access panel 110 can be removed, allowing additional access to the internal components of the beverage dispenser 100. The easy access to internal components of the beverage dispenser 100 may assist in maintenance and service of the beverage dispenser 100 and its components. The front access panel 110 can be removably attached to the trunk 104 of the beverage dispenser 100, and the front access panel 110 may provide protection to internal components of the beverage dispenser 100. The front access panel 110 can be held in place by the upper portion 106 of the beverage dispenser 100 or, alternatively, it can be secured in place by any suitable means such as, for example, screws, tabs, snaps, or bolts. The opening or closing of the beverage dispenser 100 and/or delivery of power to the beverage dispenser 100 can be controlled by other mechanisms or devices than the lock and key mechanism 108. For example, the delivery of power to the beverage dispenser 100 can be controlled by a power switch or button situated on the beverage dispenser 100.

The beverage dispenser 100 receives electrical power from the electric plug assembly 114, which can include a standard two or three-prong electric plug. The electric plug assembly 114 can further include a power transformer that is capable of receiving a standard electrical power signal such as, for example, a power signal of approximately 120V in the U.S. (or approximately 240V in European applications) and supplying the beverage dispenser 100 with an appropriate power signal. The power signal provided to the beverage dispenser 100 can be a relatively low voltage signal such as, for example, a 12V power signal.

The beverage dispenser 100 receives beverage fluids (e.g., beverage additive(s), water, carbonated water, beer, wine, etc.) through the input tubing 116. The input tubing 116 can be any tubing suitable for transporting a beverage fluid to the beverage dispenser 100 such as, for example, rubber or plastic tubing. The input tubing 116 can include one or more tubes that may or may not be insulated. For example, the input tubing 116 used to transport water from a prechiller to the beverage dispenser 100 can be insulated in order to maintain the water at a desired temperature. The input tubing 116 can be insulated with any suitable insulation material capable of maintaining a beverage fluid transported through the input tubing 116 at a desired temperature.

The control panel 126 is used to select one or more beverage options such as type of beverage, cup size, and/or other suitable option. After the beverage options are selected, a controller (not shown) controls the beverage dispenser 100 to dispense the beverage, in a manner that will be understood by those of ordinary skill in the art. One exemplary control method is described in detail in the parent application. After the beverage is dispensed through the diffuser block 300, its flow can be partially or completely directed by the nozzle 200 into a cup or other container (not shown). Although the nozzle 200 is designed to minimize splash, splatter, and overspray of the dispensed beverage, as will be described below, the drip pan 120 provided in the base 102 of the beverage dispenser 100 may catch any splash, splatter, or overspray by the beverage dispenser 100 and any spillover from the beverage receiving cup. The drip pan 120 can further be removable for emptying and cleaning. A drain can be provided at the bottom of the drip pan 120, and that the drain can transport any splash, splatter, overspray, or spillover away from the beverage dispenser 100.

The beverage dispenser 100 has a C-shaped body with a relatively small footprint and is easily transportable. The beverage dispenser 100 illustrated is approximately 8⅜" wide by approximately 11½" deep, and approximately 18⅜" tall. Due to its size, the beverage dispenser 100 is commonly referred to as a 2-wide valve tower. However, exemplary embodiments of the diffuser block described herein can be implemented in beverage dispensers of many different sizes and configurations. For example, a beverage dispenser can be a larger six- or eight-wide valve tower, i.e. with six or eight nozzles, each for dispensing one or more different beverages. In other embodiments, a beverage dispenser can be a handheld beverage gun.

FIG. 2 is a partially exploded view of various components of the beverage dispenser 100. As shown in FIG. 2, the upper portion 106 is in an opened position, the front access panel 110 has been removed, and the top access panel 112 has been removed.

The internal components of the beverage dispenser 100 include a flow control block 128 and a solenoid block 130. The solenoid block 130 is illustrated as being transparent so that its internal components are partially visible.

In operation, when a beverage fluid(s) enters the beverage dispenser 100 via the input tubing 116, the beverage fluid(s) enters the flow control block 128. The flow control block 128 includes a plurality of adjustable orifices (e.g., adjustable valves) that define the flow rate of the beverage fluid(s). The flow rate can be individually controlled for each beverage fluid and the flow rate for each beverage fluid can be set so it remains constant at a set rate for each beverage additive. When the beverage fluid(s) exits the flow control block 128, it flows to the solenoid block 130, and then from the solenoid block 130 to the diffuser block 300 (not shown in FIG. 2) in the upper portion 106. The solenoid block 130 is coupled with a plurality of solenoid valves 350. Each solenoid valve 350 controls the flow path of each of the beverage additives. When a gate is opened, a beverage fluid flows to the diffuser block 300, where it can be dispensed by the beverage dispenser 100.

FIG. 3 is a perspective view of a flow control system 140 of the beverage dispenser 100. The flow control system 140 includes the flow control block 128, the solenoid block 130, and the diffuser block 300. In operation, after a beverage fluid(s) enters the beverage dispenser 100 via the input tubing 116, it flows into the flow control block 128, and then to the solenoid block 130. The flow control block 128 controls the flow rate of the beverage fluid(s) into the solenoid block 130. The solenoid valves 350 in solenoid block 130 are actuated by the controller based on input from the control panel 126 to allow the beverage fluid(s) to flow to the diffuser block 300 for dispensing from the beverage dispenser 100. Although the solenoid block 130 is described herein as being situated downstream from the flow control block 128, the flow control block 128 can be situated downstream from the solenoid block 130. Also, a flow control system for a reconfigurable beverage dispenser can include a plurality of individual solenoids coupled with individual gate valves that are in fluid communication with the flow control block 128.

The flow control block 128 includes one or more flow control devices 122 (e.g., adjustable valve) or other flow rate control devices that control the flow rate of the beverage fluids (e.g., beverage additive(s), water, carbonated water, beer, wine, etc.) provided to the flow control block 128 by the input tubing 116. Although valves are shown in FIG. 3, other means for controlling flow rate can be used, for example, one or more orifices. The flow control block 128 provides an individual channel for each beverage fluid. The input tubing 116 is coupled to the flow control block 128. More specifically, each tube of the input tubing 116 is coupled to an associated or corresponding flow control device 122 of the flow control block 128. A flow control device 122 is provided for each beverage fluid provided to the flow control block 128. The flow rate is individually controlled for each beverage fluid by one of the flow control devices 122. Additionally, the flow rate for each beverage fluid can be set so that it remains constant for each beverage fluid. Any suitable device can be used for regulating the flow rate of the beverage fluids. The flow control devices 122 can be arranged or positioned in a staggered or offset array, thereby requiring relatively little space and, consequently, at least partially contributing to a relatively small footprint for the beverage dispenser 100.

A flow control device 122 for the beverage dispenser 100 can be constructed from any suitable material such as, for example, plastic, rubber, or a combination of plastic and rubber. The flow control block 128 can also be constructed from any number of suitable materials such as, for example, plastics, rubber, acrylics, metals, polymers, synthetic materials, or a combination of any such materials.

When a beverage fluid exits the flow control block 128, it is transported to the solenoid block 130 by solenoid input tubing 144. The solenoid input tubing 144, which can be insulated or non-insulated, can be any tubing suitable for transporting a beverage fluid from the flow control block 128 to the solenoid block 130 such as, for example, rubber or plastic tubing. The solenoid input tubing 144 can be terminated at the periphery of the solenoid block 130. Alternatively, the solenoid input tubing 144 can further extend into the solenoid block 130 to the solenoid valves 350 coupled within the solenoid block 130. One or more suitable devices such as, for example, pins, staples, or braces, can secure the solenoid input tubing 144 in place at the solenoid block 130. Although the flow control block 128 and the solenoid block 130 are depicted as two separate and distinct components of the beverage dispenser 100, the flow control block 128 and the solenoid block 130 can be integrally formed as a single component of the beverage dispenser 100.

Each of the solenoid valves 350 controls the flow path of a beverage fluid through the solenoid block 130. A solenoid valve 350 can be provided for each beverage fluid. When a solenoid valve 350 is actuated or opened, a beverage fluid flows past the solenoid valve 350, through the solenoid block 130, and exits into an output tube 146. The output tube 146 carries the beverage fluid to the diffuser block 300, where it is dispensed by the beverage dispenser 100. The control panel 126 controls the actuation of the various solenoid valves 350 based on user input, thereby dispensing a user selected beverage from the beverage dispenser 100. Control signals from the control panel 126 to the solenoids 350 are electrically communicated via solenoid wires 148, which can be any type of wire suitable for communicating an electrical signal to the solenoid valves 350.

The solenoid block 130 can form a centralized manifold for the flow of beverage fluids controlled by the array of solenoid valves 350. The use of a single block (e.g., an acrylic block) may decrease leak points, help maintain steady flow rates, and reduce pressure drops across the solenoid array. An acrylic block can also be easily machined and, if a clear acrylic block is utilized, the clear acrylic block may allow for increased visibility of the internal components of the solenoid block 130, thereby providing for easier trouble shooting of the solenoid block 130. The solenoid valves 350 can be arranged in a staggered array, as illustrated. A staggered array arrangement for the solenoid valves 350 may require relatively little space, and, consequently, at least partially contribute to a relatively small footprint for the beverage dispenser 100. In the illustrated embodiment, the solenoid block 130 is an acrylic block. However, many materials besides acrylic can be used to construct the solenoid block 130.

Each solenoid valve 350 includes a coil of wire encased in a housing with a moving plunger or shaft. When electricity is applied to the coil of a solenoid valve 350, the resulting magnetic field attracts the plunger and pulls it into the solenoid body, thereby allowing a beverage fluid to pass through the associated channel of the solenoid block 130.

When electricity is removed, the solenoid plunger returns to its original position via a return spring or gravity, thereby preventing the flow of the beverage fluid through the associated channel of the solenoid block 130. A variety of different solenoids can be used, including, but not limited to, AC solenoids, DC solenoids, linear open frame solenoids, linear tubular solenoids, rotary solenoids, or variable positioning solenoids. Each solenoid valve 350 can include any suitable solenoid such as, for example, a 2X1578-A solenoid manufactured by KIP, Inc.

When a beverage fluid enters the solenoid block 130 through the solenoid input tubing 144, the beverage fluid flows to the one of the solenoid valves 350 via an input channel integrated into the solenoid block 130. The solenoid input tubing 144 can extend into the solenoid block 130 as an alternative to integrating input channels into the solenoid block 130. Electricity can applied to the solenoid valves 350 by way of the solenoid wires 148. A solenoid plunger is actuated to allow a beverage fluid to flow past the individual solenoid valve 350 into an output channel integrated into the solenoid block 130 and then into an output tube 146, which then carries the beverage fluid to the diffuser block 300. Electricity can be applied to control the solenoid valves 350 according to the control logic of the beverage dispenser 100. In FIG. 3, the output tubes 146 terminate at the periphery of the solenoid block 130. However, the output tubes 146 can extend into the solenoid block 130 as an alternative to integrating output channels into the solenoid block 130.

The output tubing 146, which can be insulated or non-insulated, can be any tubing suitable for transporting a beverage fluid from the solenoid block 130 to the diffuser block 300 (e.g., rubber tubing, plastic tubing). One or more suitable devices such as, for example, pins, staples, or braces, can be used to secure the output tubing 146 in place relative to the solenoid block 130 and/or relative to the diffuser block 300. The nozzle 200 can assist in directing the flow of the dispensed beverage fluid, thereby may assist in the prevention of splash, splatter, and/or overspray during the dispensing of a beverage fluid from the diffuser block 300.

When a mixed beverage is dispensed from the beverage dispenser 100, two or more beverage fluids (e.g., a beverage additive(s) and water, a beverage additive(s) and carbonated water) are dispensed. A diffuser block 300 can be used to mix the dispensed beverage fluids.

Diffuser Block

Figure 4:
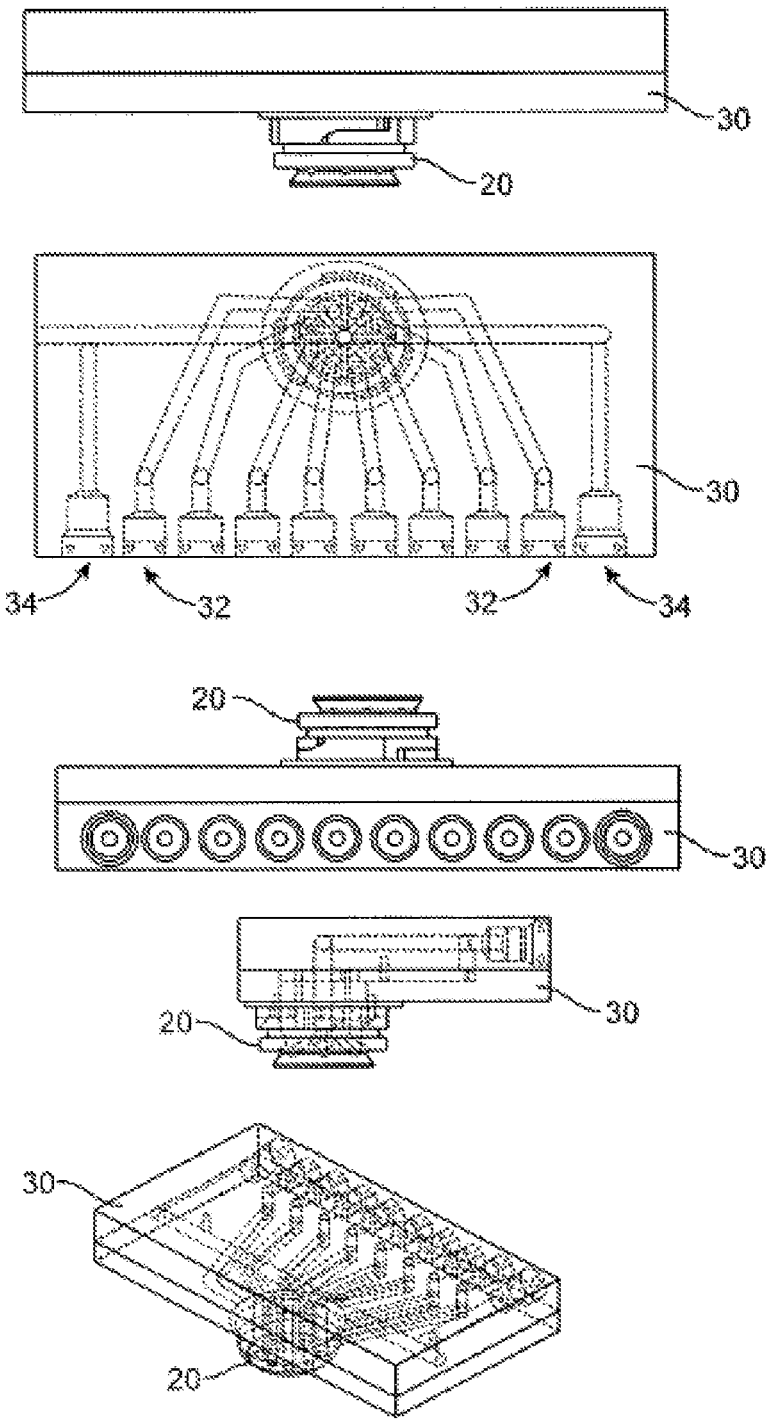
FIG. 4 (PRIOR ART)
FIG. 4 illustrates several views of a diffuser block according to the prior art.

FIG. 4 illustrates views of a known diffuser block 30. The diffuser block 30 includes a plurality of beverage additive fluid channels 32, and two base beverage fluid channels 34. Each of the beverage additive fluid channels 32 is configured to receive and convey a beverage additive to a nozzle 20. Each of the base beverage fluid channels 34 is configured to receive and convey a base beverage fluid (e.g., water, carbonated water) to the nozzle 20. Each of the fluid channels 32, 34 terminates at a separate dispensing orifice of the nozzle 20. The use of separate dispensing orifices may help to avoid cross contamination between the various beverage fluids (e.g., beverage additives, beverage base fluids such as water, carbonated water). The diffuser block 30 does not include any provisions for solenoid or flow control valves, and therefore is designed to be used in a beverage dispenser that has a flow control system 140 located upstream of the diffuser block to control the flow of the beverage additive fluids and the base beverage fluids, as described above.

Figure 5:
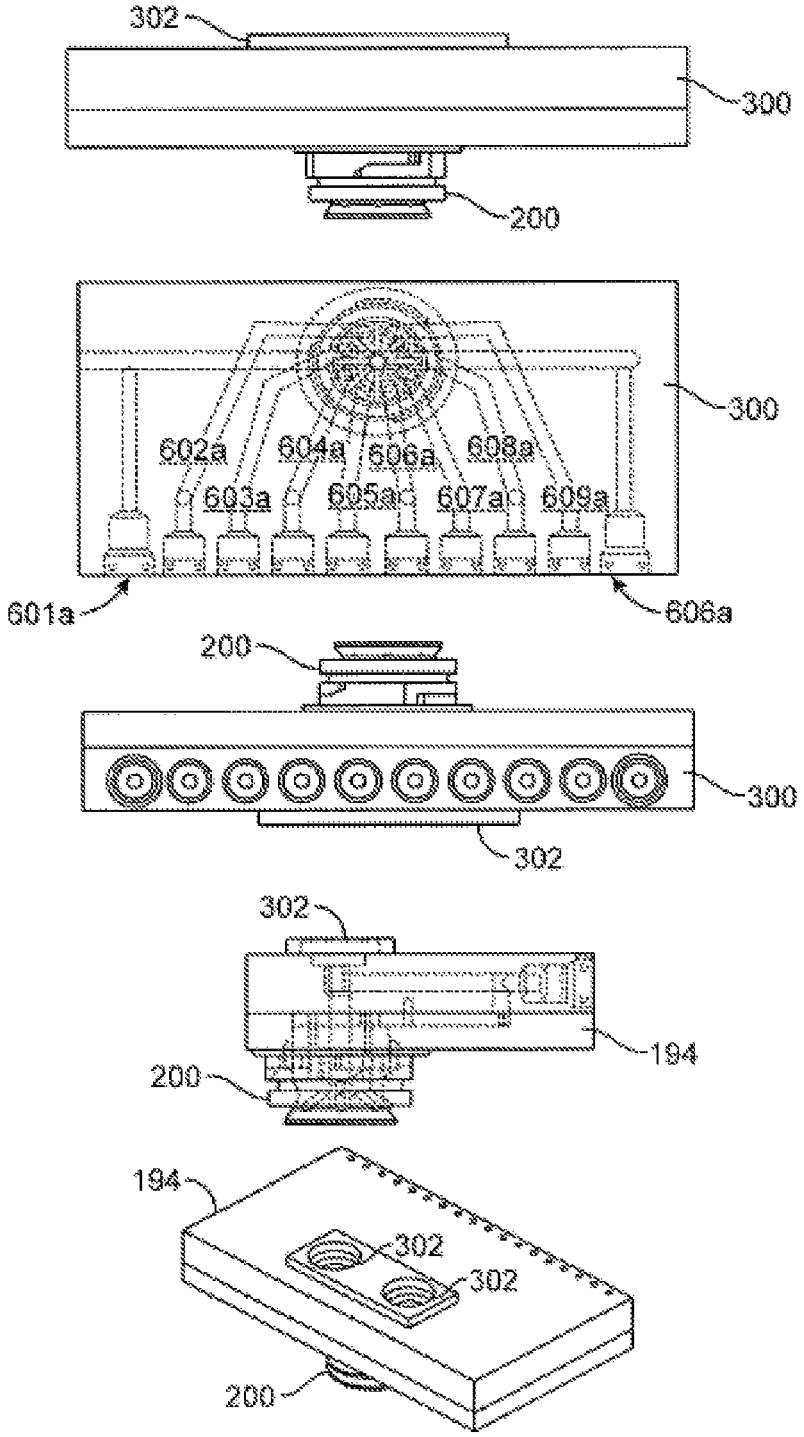
FIG. 5 illustrates several view of an exemplary diffuser block.

FIG. 5 illustrates views of a diffuser block 300, in accordance with many embodiments. The diffuser block 300 is similar to the diffuser block 30 of FIG. 4, but further includes solenoid mounting provisions 302 to mount solenoids (not shown) to control the flow of base beverage fluids (e.g., water, carbonated water) through the base beverage fluid channels 601*a*, 606*a*. For example, a water solenoid valve (not shown) and a carbonated water solenoid valve (not shown) can be mounted to the diffuser block 300 via the solenoid mounting provisions 302, which places the solenoid valves very near to the dispensing nozzle 200. Locating the soda water solenoid close to the dispense point may improve the level of carbonation in a carbonated beverage dispensed from a beverage dispenser. This configuration may also help control the volume of dripping following a dispensing of a beverage by preventing dripping associated with residual out-gassing of the carbonation of the soda water remaining in the line between the soda water solenoid valve and the dispense point. The flow regulators can still be located some distance away with the syrup controls, or can be mounted at the diffuser block along with the solenoid valves.

FIGS. 8A-8F illustrate a first exemplary diffuser block 300 in accordance with many embodiments. The block 300 includes three layers 300*a-c*, with an extender 400 attached to its bottom and a cover 500 attached to its top. The block 300 essentially serves as a manifold to connect the input tubing 116 to the nozzle 200, and thus has several fluid passageways defined therein to direct the various beverage fluids from the input tubing 116 to the nozzle 200 while avoiding cross-contamination.

In many embodiments, the top layer 300*a* directs base fluids, e.g. soda water and non-carbonated water, and the additional layers 300*b*, 300*c* direct beverage additives, e.g. concentrated soft drink syrups. The top layer 300*a* has a fluid inlet 611*a* for soda water, and a fluid inlet 616*a* for non-carbonated water. The fluid inlets are connected to fluid channels 601*a*, 606*a*, respectively, which channels are substantially along the plane of the layer 300*a*, such that they are substantially horizontal in use. The fluid channels 601*a*, 606*a* terminate in a through hole 720*a*, substantially perpendicular to the plane of the layer, such that it is substantially vertical in use.

Likewise, the next layer down, 300*b*, has fluid inlets 620*b*, 612*b*, 615*b*, 617*b*, which is use are connected to input tubing 116 containing beverage additives. The fluid inlets 620*b*, 612*b*, 615*b*, 617*b* are connected to respective fluid channels 610*b*, 602*b*, 605*b*, and 607*b*, which terminate in respective through holes 710*b*, 702*b*, 705*b*, and 707*b*. The fluid passageways defined by fluid inlets 620*b*, 612*b*, 615*b*, 617*b*; fluid channels 610*b*, 602*b*, 605*b*, and 607*b*; and through holes 710*b*, 702*b*, 705*b*, and 707*b* may, in many embodiments, be smaller in cross-section that those 611*a*, 616*a*, 601*a*, and 606*a*, to accommodate for the lower flow rates of beverage additives than of base beverages. Layer 300*b* also has an additional through hole 720*b* therein, which is adjacent to and in fluid communication with the through hole 720*a* in layer 300*a*, to provide an outlet for the base beverages traveling downward through the through hole 720*a* toward the layer 300*b*. The additional through hole 720*b* may have a larger cross-section than the through holes 710*b*, 702*b*, 705*b*, and 707*b* to account for the higher flow rates of base beverages.

The next layer 300*c* of the illustrated embodiment is connected to additional beverage additive sources, and has similar, smaller-size fluid passageways defined therein; namely fluid inlets 619*c*, 611*c*, 613*c*, 614*c*, 616*c*, and 618*c*, connected to respective fluid channels 609*c*, 601*c*, 603*c*, 604*c*, 606*c*, and 608*c*, which terminate in respective through holes 709*c*, 701*c*, 703*c*, 704*c*, 706*c*, and 708*c*. Layer 300*c* also has additional through holes 710*c*, 702*c*, 705*c*, 707*c*, and 720*c*, adjacent and in fluid communication with the through holes 710*b*, 702*b*, 705*b*, 707*b*, and 720*b*, respectively, to provide outlets for the beverage components traveling down through the layer 300*b*. The through hole 720*c* may have a larger cross-section than the other through holes in this layer to account for the higher flow rates of base beverages.

Attached to the bottom of the layer 300*c* is an extender 400, with through holes 401, 402, 403, 404, 405, 406, 407, 408, 409, 410, and 420, adjacent and in fluid communication with through holes 701*c*, 702*c*, 703*c*, 707*c*, 705*c*, 706*c*, 707*c*, 708*c*, 709*c*, 710*c*, and 720*c*, respectively. The through hole 720*c* may have a larger cross-section than the other through holes in the extender 400 to account for the higher flow rates of base beverages.

A nozzle 200 surrounds the extender 400, and funnels the beverage components exiting the extender 400 into a drinking cup or other container.

Figure 6:
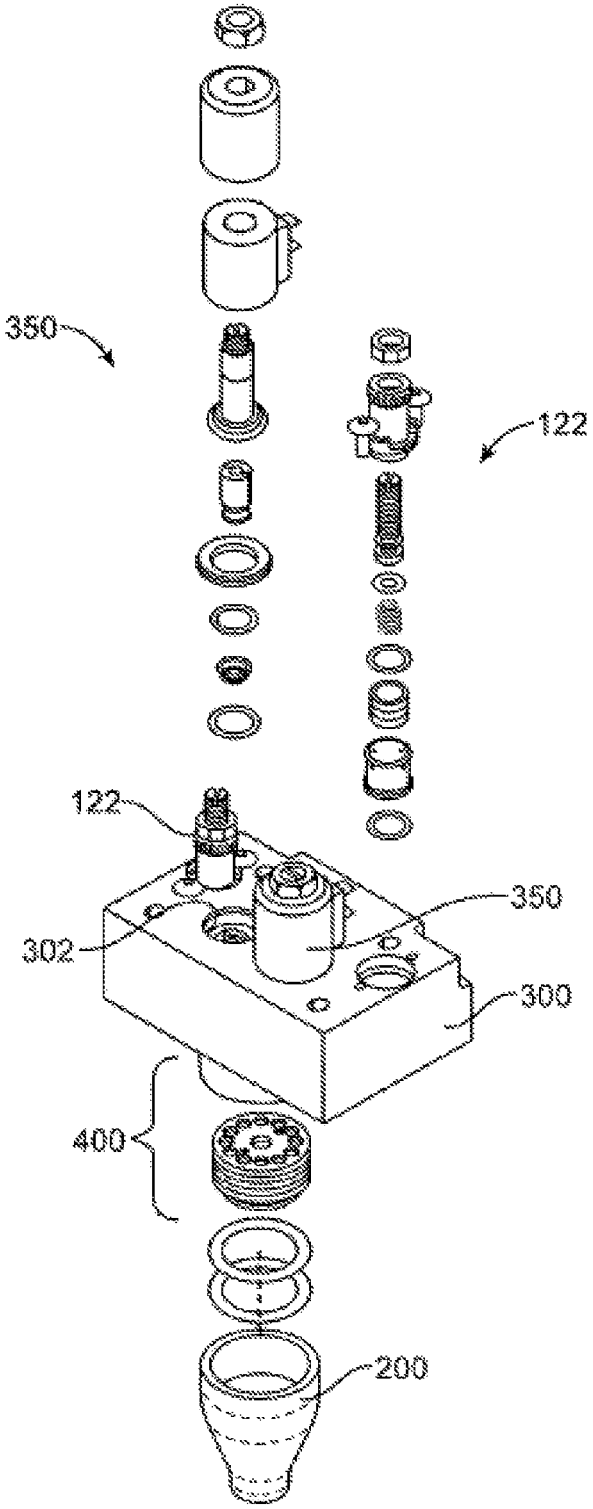
FIG. 6 is an exploded perspective view of an assembly of the diffuser block of FIG. 5 with an associated nozzle and shutoff valves.
Figure 7:
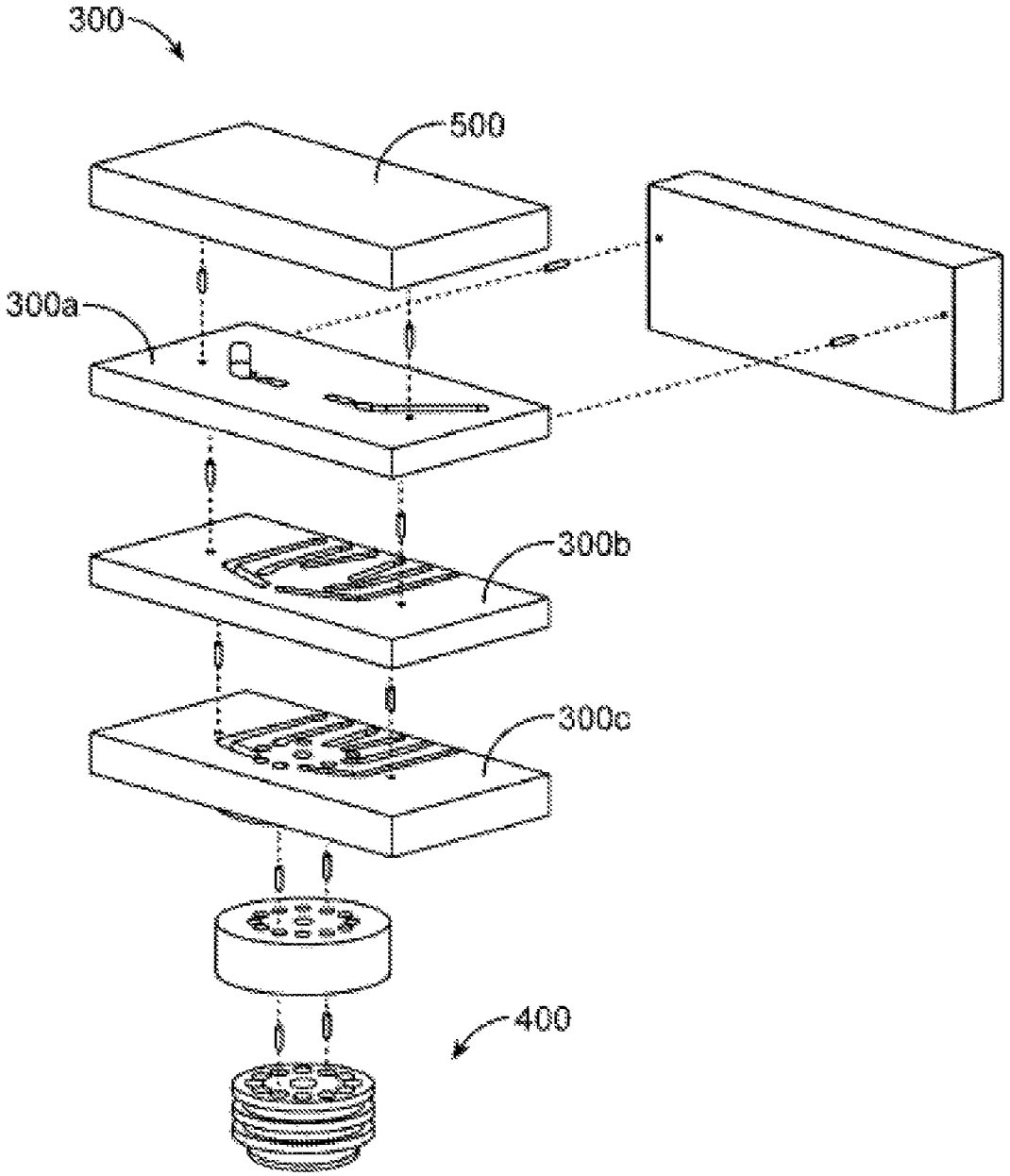
FIG. 7 is an exploded perspective view of the diffuser block of FIG. 5 with an associated extension.
Figure 8C:
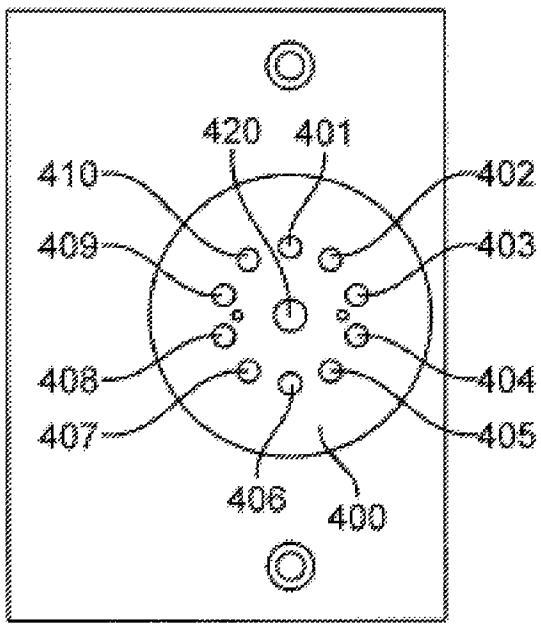
FIG. 8C is a bottom view of the diffuser block of FIG. 5.
Figure 8B:
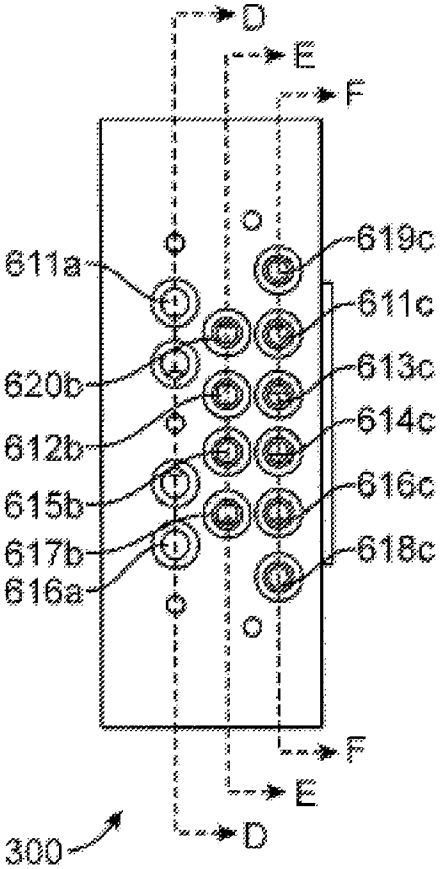
FIG. 8B is a side view the diffuser block of FIG. 5.
Figure 8A:
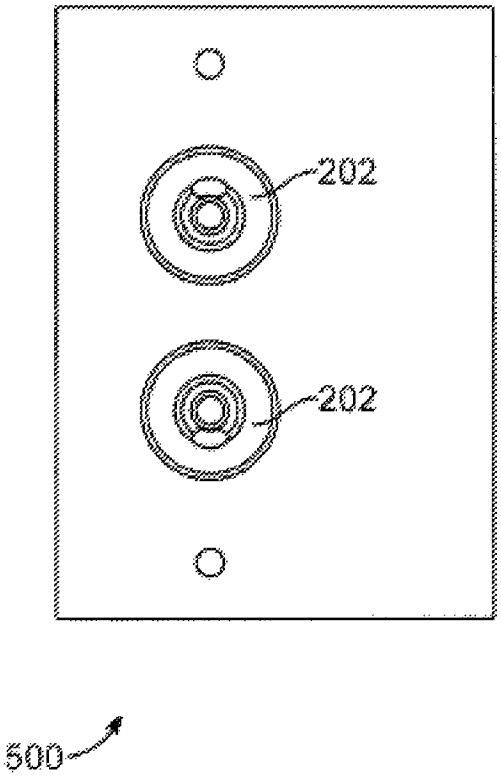
FIG. 8A is a plan view of the diffuser block of FIG. 5.
Figure 8F:
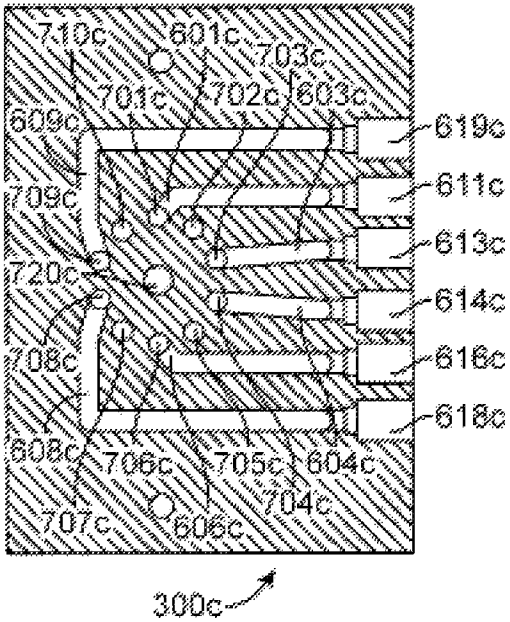
FIG. 8F is a cross-sectional view taken along line F-F of FIG. 8B.
Figure 8E:
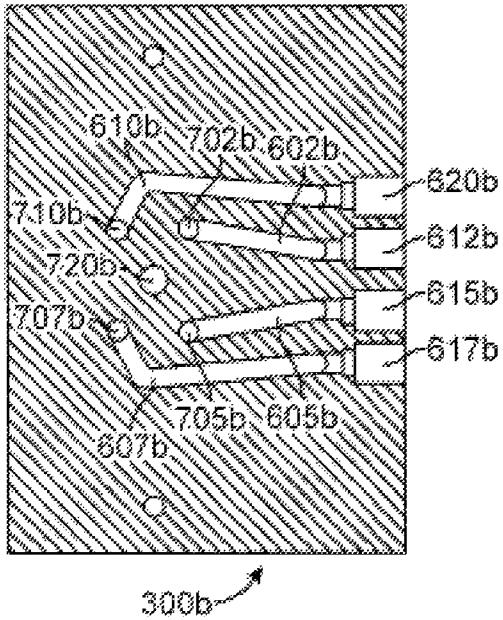
FIG. 8E is a cross-sectional view taken along line E-E of FIG. 8B.
Figure 8D:
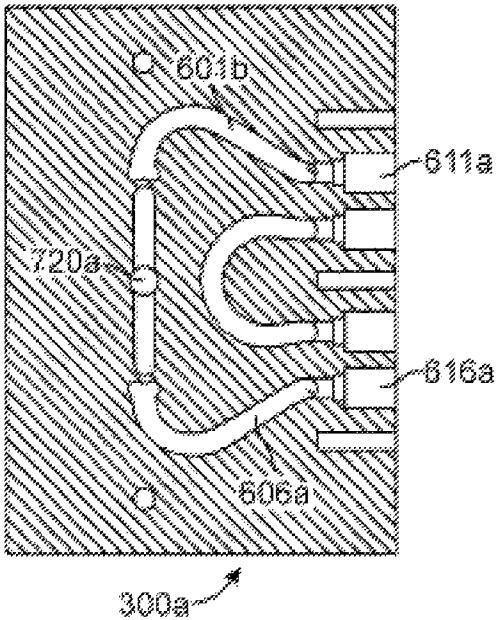
FIG. 8D is a cross-sectional view taken along line D-D of FIG. 8B.

In many embodiments, the top layer 300*a* and the cover 500 have valve bores provided therein, with the solenoid and/or flow control valves for the base beverages provided in the valve bores. In the embodiment illustrated in FIGS. 7-8, only the solenoid valves are provided at the diffuser block 300, with the flow control valves located upstream of the diffuser block, such as in the flow control block 128 shown in FIGS. 2 and 3, but other configurations are possible. For example, FIG. 6 shows a modification in which the flow control devices 122 for the base beverages are also provided in valve bores of the diffuser block. Also in the embodiments illustrated in FIGS. 6-8, the solenoid valves associated with the beverage additives are also located upstream of the diffuser block, such as in the solenoid block 130 shown in FIGS. 2 and 3, but other configurations are possible.

The solenoid shutoff valves 350 associated with the base beverages (e.g. soda water and non-carbonated water), and in some embodiments, the flow control devices 122 associated with the base beverages, are thus almost immediately adjacent the nozzle. The small distance, and thus the small amount of fluid, between the shutoff valves and the nozzle prevents dripping when the beverage dispenser 100 is not in use, as well as preventing, e.g. soda water from going flat by having a large unpressurized section of the fluid channel.

In many embodiments, the layers 300*a-c* are molded or machined, then bonded together, along with the cover layer 500 and the extender 400. The valve bores are then drilled through the cover layer 500 and the top layer 300*a*.

As described above, the base beverage fluids are generally routed through the beverage dispenser 100 at a higher flow rate than the beverage additives. It has been found that when soda water is mixed with particular beverage additives, the resulting beverage is foamy. This can lead to a beverage of inferior quality, or too small a quantity once the foam has settled. It can also lead to the beverage container foaming over.

Figure 9:
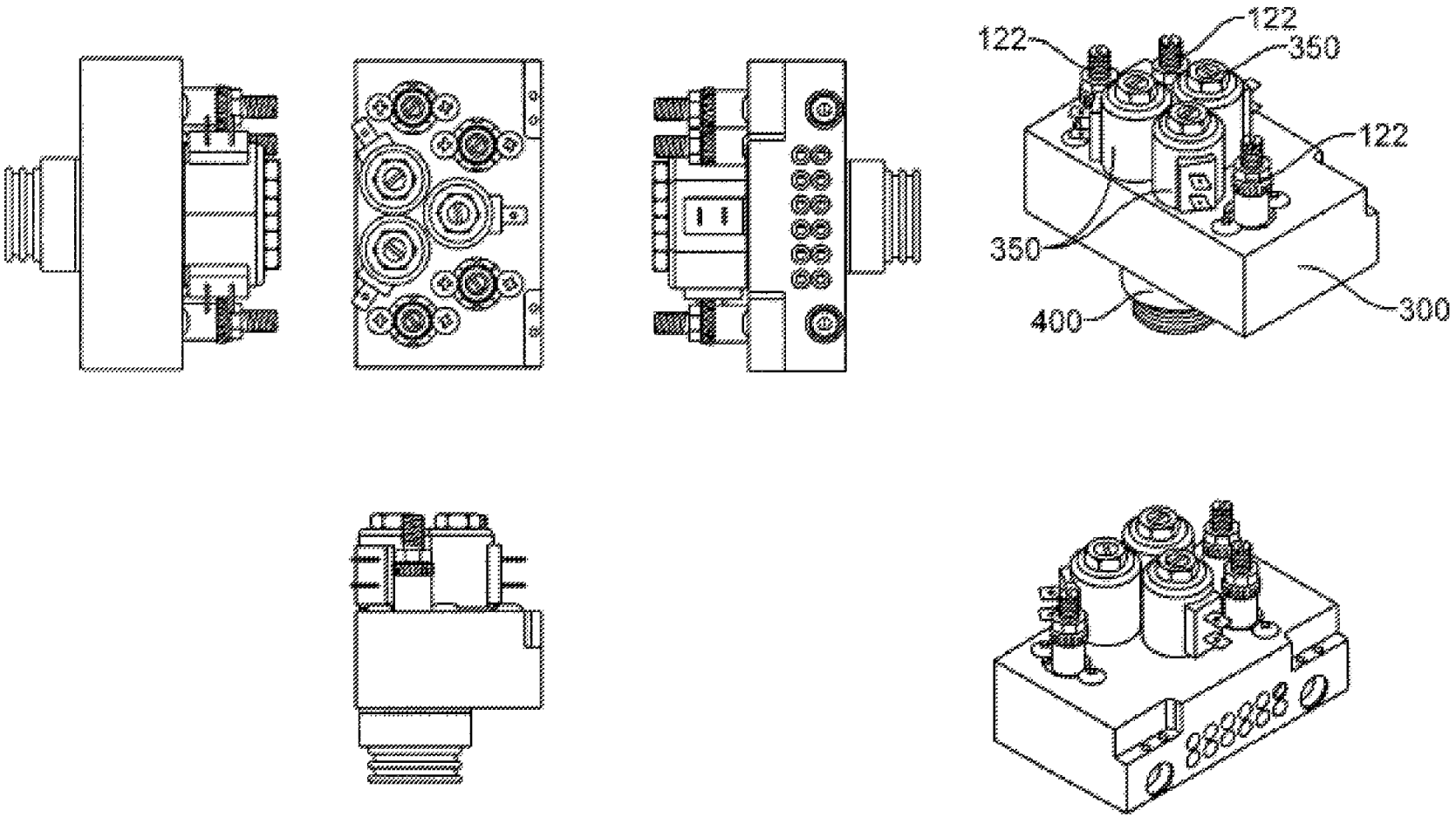
FIG. 9 illustrates several views of a diffuser block according to an alternative embodiment, with associated shutoff valves.

Therefore, as illustrated in FIG. 9, many embodiments provide a third solenoid valve bore in the diffuser block 300 with a third solenoid valve therein. In embodiments in which the flow control devices 122 associated with the base beverages are also provided at the diffuser block 300, a third flow control valve bore may also be provided. It will be understood that the top layer 300*a* of these embodiments thus has three fluid inlets, and three fluid channels. The top layer 300*a* may have one fluid passageway connected to a non-carbonated water source and two fluid passageways connected to soda water. Flow control valves 122, located at or upstream of the diffuser block 300, may provide soda water at two different flow rates in the two soda water fluid passageways. The controller (not shown) can be programmed to recognize which combinations of beverage fluids yield likely foamy results, and control the flow control and solenoid valves to send soda water through the lower flow rate fluid passageway, rather than the standard flow rate fluid passageway, for these beverages.

The embodiments that have been illustrated and described thus far provide solenoid valves at the diffuser block for two base beverages, and solenoid valves for eight (FIG. 5) or twelve (FIGS. 6-9) beverage additives upstream of the diffuser block. However, the invention is not limited thereto. Any number of base beverages or beverage additives may be provided. Solenoid valves may be provided at the diffuser block for one, two, or more base beverages, or for none. Solenoid valves may be provided at the diffuser block for any number of beverage additives. Solenoid valves may be provided upstream of the diffuser block for one, two, or more base beverages, or for none. Solenoid valves may be provided upstream of the diffuser block for any number of beverage additives. Some applications may not have a distinction between "base beverages" and "beverage additives" as defined herein. These embodiments may provide solenoid valves at and/or upstream of the diffuser block in any numbers for any beverages or beverage components. Some embodiments may have flow control valves at and/or upstream of the diffuser block for base beverages, beverage additives, or other beverages or beverage components. Some applications may be used to route fluids other than beverages. In addition, though a beverage tower has been illustrated and described, the diffuser block as defined herein can be used for a beverage gun or any other beverage or fluid dispensing apparatus.

Figure 10:
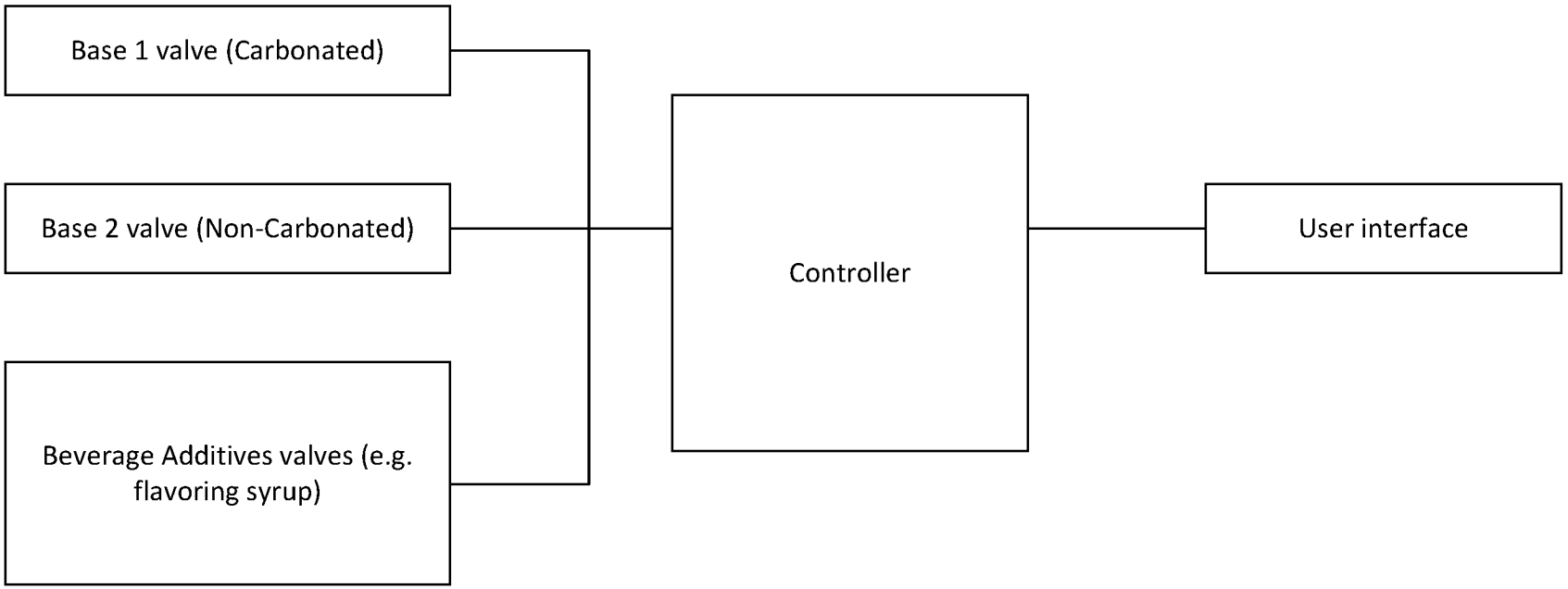
FIG. 10 illustrates a high level schematic of a user interface, controller, and valves.

The beverage dispensers, with manifolds, as disclosed above may be used with the controller of FIG. 10 and valve timing schemes of FIGS. 11A, 11B, 12A and 12B.

It is sometime desirable to dispense beverages that are carbonated at a level that is less than the carbonation level of the carbonated water supplied as a base fluid. For example if full strength soda water is considered to be 100% carbonated, and still water is considered to be 0% carbonated, it may be desirable to dispense a flavored beverage that is 50% carbonated. Drinks that are partially carbonated are sometimes referred to as either "Sparkling" or "Mid-Carb". It is further desirable to dispense 0%, 100% and "mid-carb" beverages from the same dispenser machine. Therefore, in embodiments a dispensed beverage may include any ratio of non-carbonated base fluid and carbonated base fluid.

A user interface may allow a user to select a beverage flavor, which may be achieved by dispensing one or more beverage additives, and then allow for selection of a carbonation level of any amount between 0-100%. Additionally, embodiments may also allow for selection of a beverage with a pre-determined partial carbonation, for example sparkling lime water with 30% carbonation. In embodiments, the user interface may further allow a dispensed volume to be selected, e.g. small/medium/large cup, referred to as "Portion controlled" or may allow for on demand dispensing of the selected beverage, referred to as "Push-and-Hold". For portion controlled applications, the dispenser dispenses the pre-selected volume of beverage. For Push-and-hold applications, the dispenser begins dispensing a beverage and terminates dispensing upon a user initiated termination signal. Once a beverage is selected, the controller determines a valve timing scheme to be used to dispense the beverage with the desired carbonation level, i.e. ratio of carbonated water to non-carbonated water.

FIG. 10 shows a high level schematic of a user interface, controller, and valves. The controller sends signals to open and close the valves based on the valve timing scheme determined based on user input.

Figure 11A:
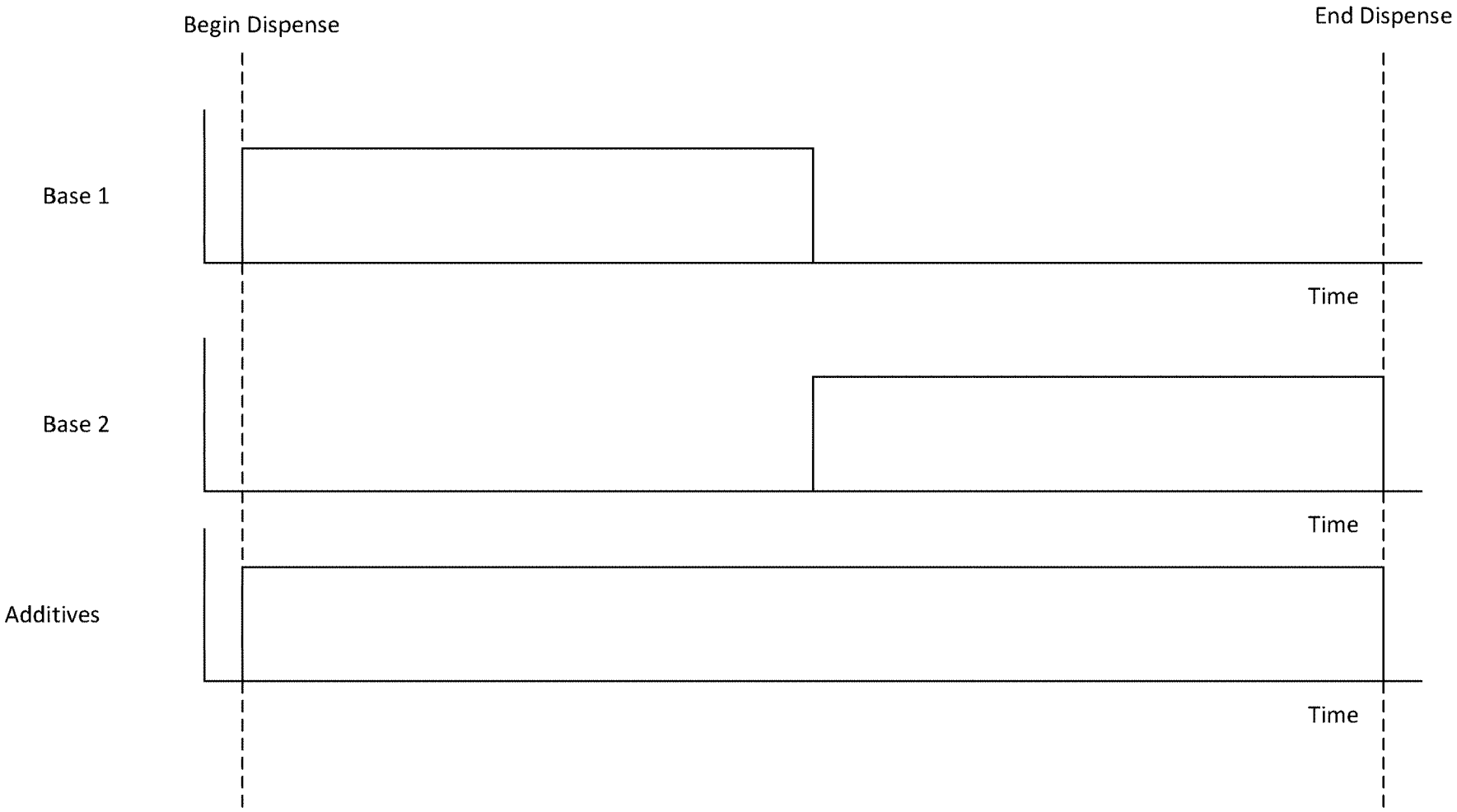
FIGS. 11A and 11B illustrate valve timing schemes for portion controlled beverage dispensing.
Figure 11B:
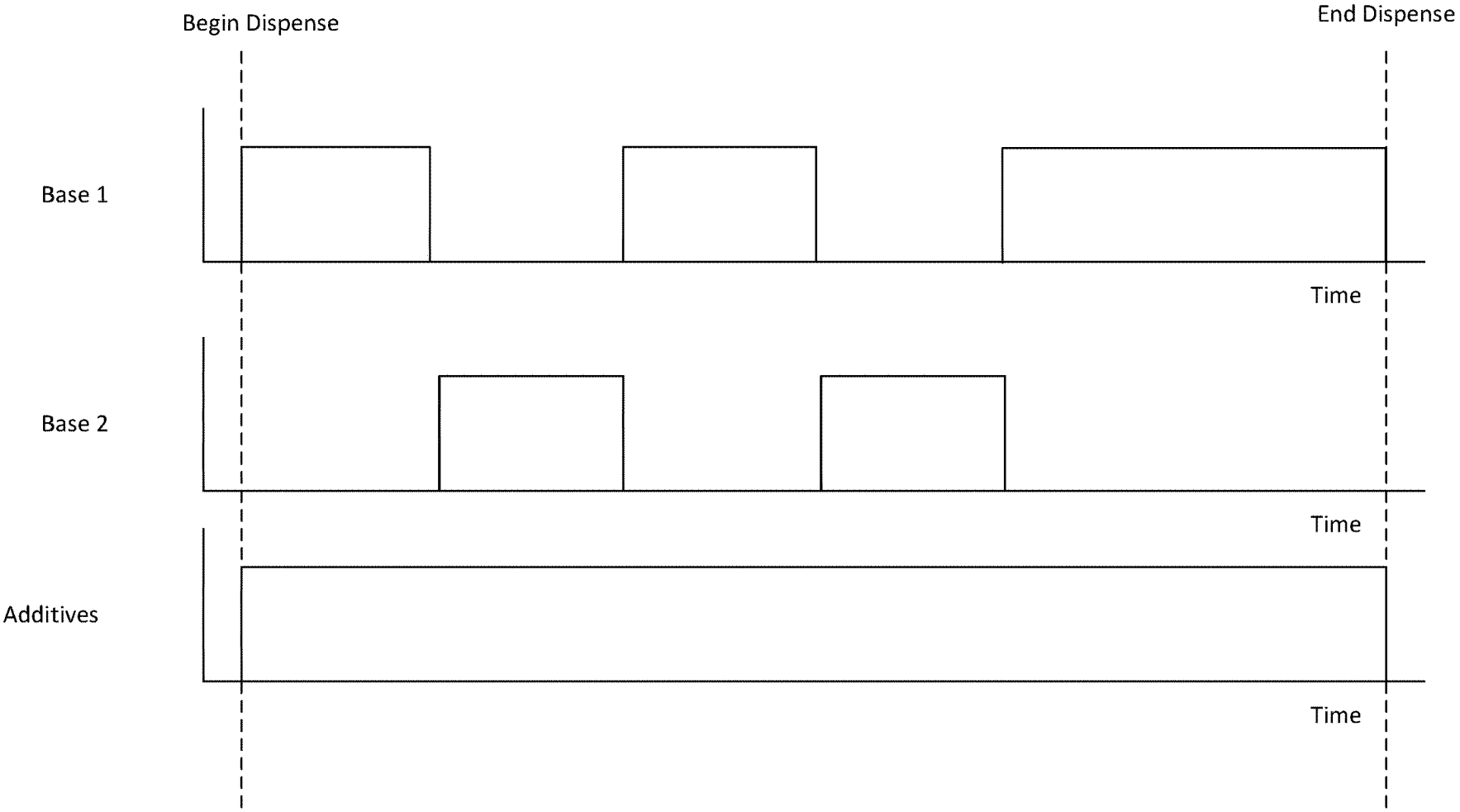

FIG. 11A shows a valve timing scheme to dispense a beverage including a mixture of two base fluids for a predetermined volume of dispensed beverage. In the embodiment shown, Base 1, non-carbonated water, is first dispensed, followed by dispensing Base 2, carbonated water. In the embodiment shown, additives, such as flavored syrups are continually dispensed while the base fluids are dispensed. However, in embodiments, additives may be dispensed with other valve timings, such as before or after dispensing of base fluids, or in multiple discrete doses before, during, and/or after dispensing base fluids. Further in embodiments, dispensing of each base fluid may be done in one or more discrete doses, and the discrete doses may have uniform durations or different durations, as is shown in the valve timing scheme in FIG. 11B. As shown in FIG. 11B, two doses of Base 1 and Base 2 of equal duration are alternately dispensed, followed by dispensing a longer dose of Base 1 in order to achieve the desired carbonation level in the portion controlled dispensed drink. Further, in embodiments, bases fluids may be dispensed simultaneously.

While the valve timing schemes of FIGS. 11A and 11B are suitable for a predetermined volume of dispensed beverage, they are not suitable for on demand beverage dispensing because in order to achieve the desired carbonation level the schemes of FIGS. 11A and 11B must be performed through completion, i.e. if you stop part way through the timing scheme the resulting beverage may not have the desired carbonation level.

Figure 12A:
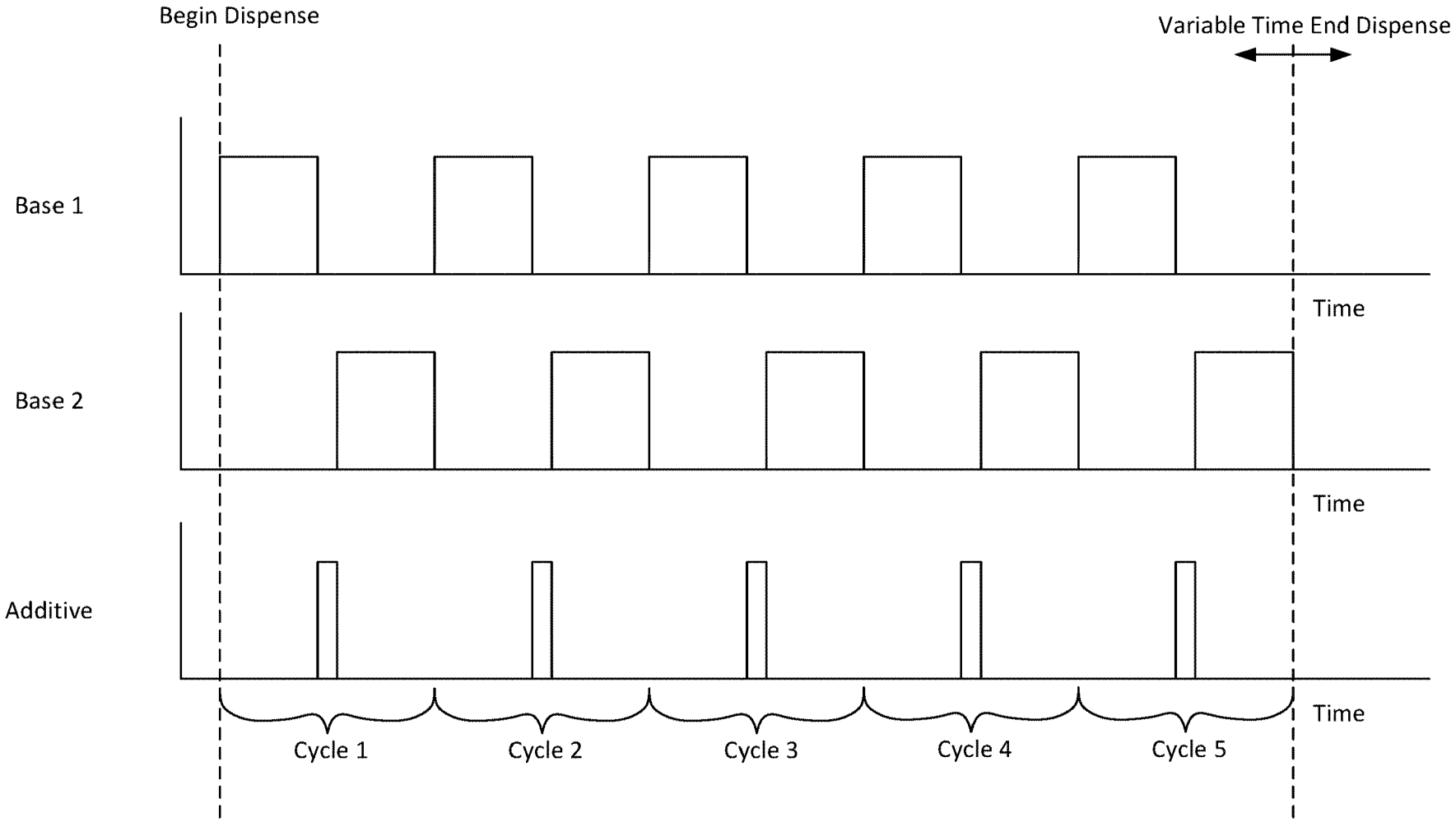
FIGS. 12A and 12B illustrate valve timing schemes for on demand beverage dispensing.

FIG. 12A shows a valve timing scheme to dispense a beverage including a mixture of two base fluids for on-demand, or predetermined volume, dispensing of beverages. As shown, Base 1 and Base 2 are alternately dispensed in discrete doses. In the embodiment shown, the volume dispensed in each dose of Base 1 is the same, and the volume dispensed in each does of Base 2 is the same. Further, as shown in FIG. 12, the doses of beverage components are dispensed in cycles. Each cycle includes doses of each component of the dispensed beverage in the desired ratio. Therefore, upon completion of each cycle, the total volume of beverage dispensed from all the cycles has the desired ratio of carbonation. In embodiments, each cycle may dispense between 0.1 and 0.5 fluid ounces, and therefore 32 to 160 cycles would be needed to dispense a 16 oz. cup of beverage.

With this method of FIG. 12A, dispensing can be terminated at any time and the resulting dispensed beverage will have the desired carbonation level. In some embodiments, once a termination command is received the controller may complete the cycle currently being dispensed in order to achieve precise ratio of components. The volume dispensed in each cycle and the duration of each cycle may both be small enough so the fluid dispensed after the termination command is issued is minimized in order to avoid overfilling a cup. In embodiments, the number of cycles to dispense a typical beverage volume may be high enough so that once a termination command is issued the controller ends dispensing practically immediately regardless of which point in a cycle the dispenser is currently performing. In the embodiment shown in FIG. 12A, if dispensing is terminated mid cycle the number of dispensed doses of one base fluid compared to the other will never exceed 1, and therefore with a high number of cycles this difference of will have a negligible effect on the overall ratio of the dispensed beverage.

Figure 12B:
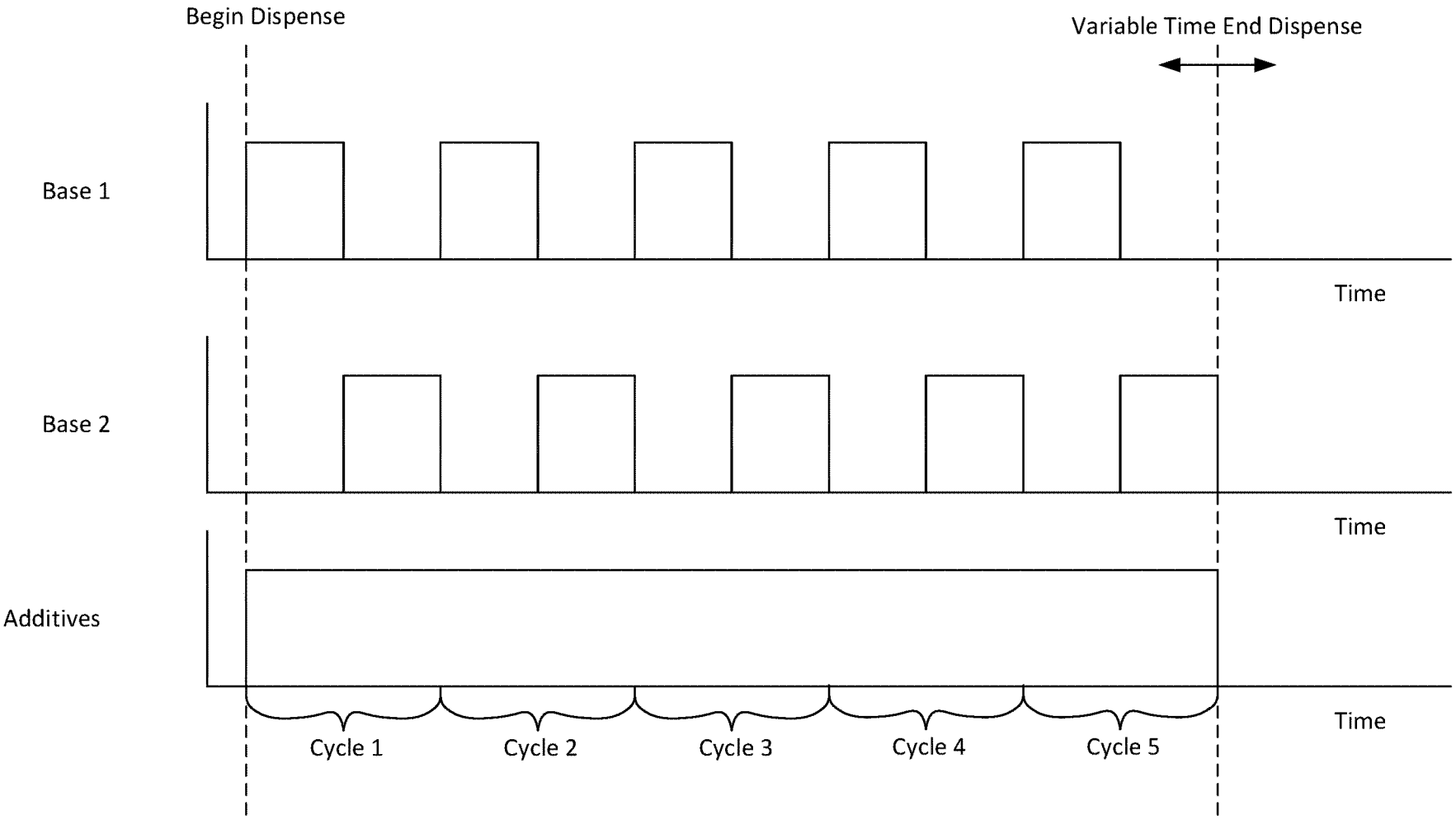

As shown in FIG. 12B, in some embodiments Base 1 and Base 2 may be dispensed in cycles similar to FIG. 12A, while additives are dispensed continuously.

In some embodiments, the flow rates of base fluids and additives, may be different, and often are. For example, the flow rate for non-carbonated water may be much higher than for carbonated water, and therefore to achieve for example a 50/50 mixture of non-carbonated water and carbonate water, the non-carbonated valve will only be open for a fraction of the time the carbonated valve is actuated. Further, in some embodiments, the dispenser may include more than two base fluid lines with controllable valves. The different base fluids lines/valves may each include a different flow rate or different carbonation level. In some embodiments, valve time schemes similar to as shown in FIGS. 11A-12B, may include doses from each of the three or more base fluids.

The above description is illustrative and is not restrictive. A recitation of "a", "an" or "the" is intended to mean "one or more" unless specifically indicated to the contrary. Many variations of the disclosure will become apparent to those skilled in the art upon review of the disclosure. One or more features from any embodiment described herein, and including embodiments described in applications incorporated by reference, may be combined with one or more features of any other embodiment without departing from the scope of the disclosure. The scope of the disclosure should, therefore, be determined not with reference to the above description, but instead should be determined with reference to the pending claims along with their full scope or equivalents.

What is claimed is:

1. A control system for a beverage dispenser, comprising:

a user interface configured to receive a beverage selection including a carbonation level and a predetermined volume; and a controller configured to determine a valve timing scheme for a first valve for a carbonated fluid and a second valve for a non-carbonated fluid in order to dispense the predetermined volume of the selected beverage with the selected carbonation level, and configured to actuate the first valve and second valve according to the valve timing scheme to dispense the predetermined volume of the selected beverage with the selected carbonation level;

wherein the valve timing scheme comprises a first dispensing portion and a second dispensing portion, performed after the first dispensing portion, wherein the first dispensing portion comprises a plurality of cycles, wherein each cycle comprises opening and closing the first valve to dispense a first volume of the carbonated fluid, and opening and closing the second valve to dispense a second volume of the non-carbonated fluid, wherein the first volume is uniform for each cycle, and the second volume is uniform for each cycle, wherein the second dispensing portion comprises opening and closing only one of the first valve or the second valve in order to dispense a third volume of only one of the carbonated fluid or the non-carbonated fluid in order to complete the dispensing of the predetermined volume of the selected beverage with the selected carbonation level, and wherein the third volume is greater than the first volume and greater than the second volume.

2. The control system of claim 1, wherein the first volume and the second volume are equal.

3. The control system of claim 1, wherein the first volume is dispensed over a first duration, the second volume is dispensed over a second duration, and the third volume is dispensed over a third duration, wherein the first duration and the second duration are equal, and wherein the third duration is longer than the first duration and longer than the second duration.

4. The control system of claim 1, wherein the valve timing scheme further comprises a flavor valve timing scheme for a flavor valve to dispense a flavor, wherein each cycle of the first dispensing portion comprises opening and closing the flavor valve to dispense a fourth volume of the flavor, wherein the second dispensing portion comprises opening and closing the flavor valve a plurality of times to dispense the fourth volume of the flavor a plurality of times, and wherein the fourth volume is uniform for each cycle and for each dispensing in the second dispensing portion.

5. The control system of claim 1, wherein the valve timing scheme further comprises a flavor valve timing scheme for a flavor valve to dispense a flavor, wherein the flavor valve dispenses the flavor continuously during the first dispensing portion and the second dispensing portion of the valve timing scheme.

6. The control system of claim 1, wherein the valve timing scheme further includes timing for one or more additional valves for a second carbonated fluid with a different level of carbonation than the carbonated fluid.

7. The control system of claim 1, wherein the valve timing scheme is configured to be adjusted via the user interface.

8. The control system of claim 1, wherein the user interface is configured to allow the carbonation level to be selectable to be any value in a range of between 0% carbonation and 100% carbonation.

9. A beverage dispenser, comprising:

a control system according to claim 1;

the first valve; and the second valve.

10. A method of dispensing a partially carbonated beverage with the control system of claim 1, the method comprising:

with the user interface, receiving the beverage selection including the carbonation level and the predetermined volume;

with the controller, determining the valve timing scheme for the first valve for the carbonated fluid and the second valve for the non-carbonated fluid to dispense the predetermined volume of the selected beverage with the selected carbonation level; and actuating the first valve and the second valve according to the valve timing scheme to dispense the predetermined volume of the selected beverage with the selected carbonation level.

11. A control system for a beverage dispenser, comprising:

a user interface configured to receive a beverage selection including a carbonation level, a user initiated dispensing input and a user initiated termination input; and a controller configured to determine a valve timing scheme for a cycle of dispensing a dose of the selected beverage with the selected carbonation level, wherein a cycle comprises opening and closing a first valve to dispense a first volume of a carbonated fluid, and opening and closing a second valve to dispense a second volume of a non-carbonated fluid;

wherein the controller is further configured to:

determine that the user initiated dispensing input is received, and in response to determining that the user initiated dispensing input is received, actuating the first valve and the second valve according to the valve timing scheme to continuously dispense doses in one or more consecutive cycles;

continue to actuate the first valve and the second valve according to the valve timing scheme after the user initiated dispensing input is received in order to continuously dispense the doses in the one or more consecutive cycles until the user initiated termination input is received, and determine that the user initiated termination input is received, and in response to determining that the user initiated termination input is received, immediately terminating actuation of the first valve and the second valve irrespective of a point of the cycle that is dispensing when the termination input is received.

12. The control system of claim 11, wherein the first volume and the second volume are each between 0.1 and 0.5 fluid ounces.

13. The control system of claim 11, wherein the valve timing scheme further includes timing for one or more additional valves for beverage additives including flavorings.

* * * * *